US006867679B2

(12) United States Patent
Montante

(10) Patent No.: US 6,867,679 B2
(45) Date of Patent: Mar. 15, 2005

(54) MOUNTING FOR CIRCUIT INTERRUPTER

(75) Inventor: Jorge R. Montante, Cicero, IL (US)

(73) Assignee: S & C Electric Co., Chicago, IL (US)

( * ) Notice: Subject to any disclaimer, the term of this patent is extended or adjusted under 35 U.S.C. 154(b) by 443 days.

(21) Appl. No.: 10/196,312

(22) Filed: Jul. 16, 2002

(65) Prior Publication Data

US 2004/0169577 A9 Sep. 2, 2004

Related U.S. Application Data

(60) Provisional application No. 60/308,363, filed on Jul. 26, 2001.

(51) Int. Cl.[7] ..... H01H 85/20; H01R 13/24

(52) U.S. Cl. ..... 337/174; 337/175; 337/178; 337/180; 439/298; 439/818

(58) Field of Search ..... 337/168, 169, 337/171, 174, 175, 178, 180, 227, 260–262; 439/298, 818, 872

(56) References Cited

U.S. PATENT DOCUMENTS 2,088,415 A * 7/1937 Heinrich ..... 337/176
2,331,843 A * 10/1943 Nelson et al. ..... 337/176
2,362,314 A * 11/1944 Schultz et al. ..... 337/156
2,365,113 A * 12/1944 Schultz ..... 337/170
2,424,126 A * 7/1947 Smith, Jr. ..... 337/62
2,668,214 A * 2/1954 Vordtriede ..... 337/178
2,689,284 A * 9/1954 Hill ..... 337/173
2,899,669 A * 8/1959 Johanson ..... 439/157
2,910,560 A * 10/1959 Stroup et al. ..... 337/174
4,268,811 A * 5/1981 Evans et al. ..... 337/156
4,542,363 A * 9/1985 Kato et al. ..... 337/31
4,546,341 A * 10/1985 McNaghten et al. ..... 337/177
4,687,277 A * 8/1987 Biller ..... 439/621

* cited by examiner

*Primary Examiner*—Anatoly Vortman
(74) *Attorney, Agent, or Firm*—James V. Lapacek

(57) ABSTRACT

A mounting for a circuit interrupter is provided that facilitates the easy removal and insertion of the circuit interrupter. The mounting includes upper and lower terminal and support arrangements that cooperate with upper and lower device mounting studs of a circuit interrupter. The device mounting studs also function as electrical circuit connection points to connect the circuit interrupter in an electrical circuit via respective upper and lower contact assemblies of the mounting. The upper and lower contact assemblies include resilient retention facilities for providing suitable electrical contact forces when engaged with the device mounting studs. The upper and lower terminal and support arrangements retain the circuit interrupter within the mounting and are selectively operable to release the circuit interrupter for removal from the mounting. Each of the terminal and support arrangements include a latch arm that is moved to release the respective device mounting stud from a retained holding position to a latch release position. The mounting also includes a resilient guiding member that cooperates with one or more of the latch arms to retain the circuit interrupter in a latched released position after operation of the latch arm. The resilient guiding member includes a protruding arm that acts against the device mounting stud as the latch arm is moved outwardly to release the device mounting studs.

5 Claims, 4 Drawing Sheets

MOUNTING FOR CIRCUIT INTERRUPTER

This application claims the benefit of U.S. Provisional Application No. 60/308,363 filed on Jul. 26 2001.

BACKGROUND OF THE INVENTION

1. Field of the Invention

The present invention relates generally to the field of circuit interrupters for electrical power transmission and distribution and more particularly to a mounting for a circuit interrupter that assists in the easy removal of the circuit interrupter from the mounting.

2. Description of the Related Art

Many types of circuit interrupting devices in the electrical power distribution and transmission field are installed in mountings so as to be selectively removable from the mountings. For example, various types of mountings for diverse circuit interrupters are shown in U.S. Pat. Nos.: 4,123,639; 4,536,822; 4,687,277; 4,463,227; 4,422,062; 4,414,527 and 5,502,427.

While the mountings of the prior art may be generally suitable for their intended uses, it would be desirable to provide a simple mounting for large circuit interrupters such that one operator can release and remove the circuit interrupter from the mounting.

SUMMARY OF THE INVENTION

Accordingly, it is a principal object of the present invention to provide a mounting arrangement for a circuit interrupter that includes facilities to assist in the removal of the circuit interrupter from the mounting.

This and other objects of the present invention are efficiently achieved by a mounting for a circuit interrupter that facilitates the easy removal and insertion of the circuit interrupter. The mounting includes upper and lower terminal and support arrangements that cooperate with upper and lower device mounting studs of a circuit interrupter. The device mounting studs also function as electrical circuit connection points to connect the circuit interrupter in an electrical circuit via respective upper and lower contact assemblies of the mounting. The upper and lower contact assemblies include resilient retention facilities for providing suitable electrical contact forces when engaged with the device mounting studs. The upper and lower terminal and support arrangements retain the circuit interrupter within the mounting and are selectively operable to release the circuit interrupter for removal from the mounting. Each of the terminal and support arrangements include a latch arm that is moved to release the respective device mounting stud from a retained holding position to a latch release position. The mounting also includes a resilient guiding member that cooperates with one or more of the latch arms to retain the circuit interrupter in a latched released position after operation of the latch arm. The resilient guiding member includes a protruding arm that acts against the device mounting stud as the latch arm is moved outwardly to release the device mounting studs.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
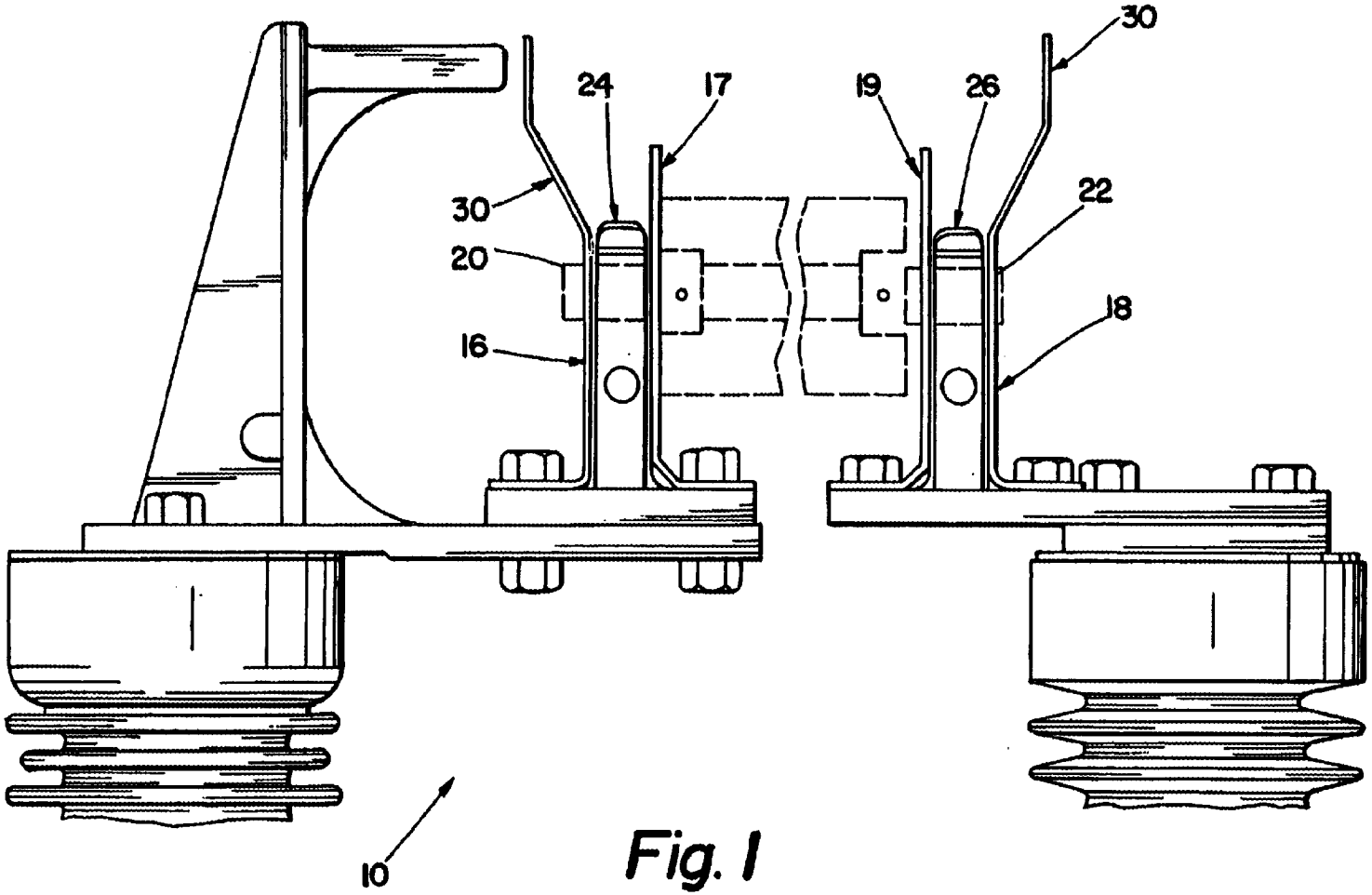
FIG. 1 is a front elevational view of the mounting for a circuit interupter according to the present invention.
Figure 2:
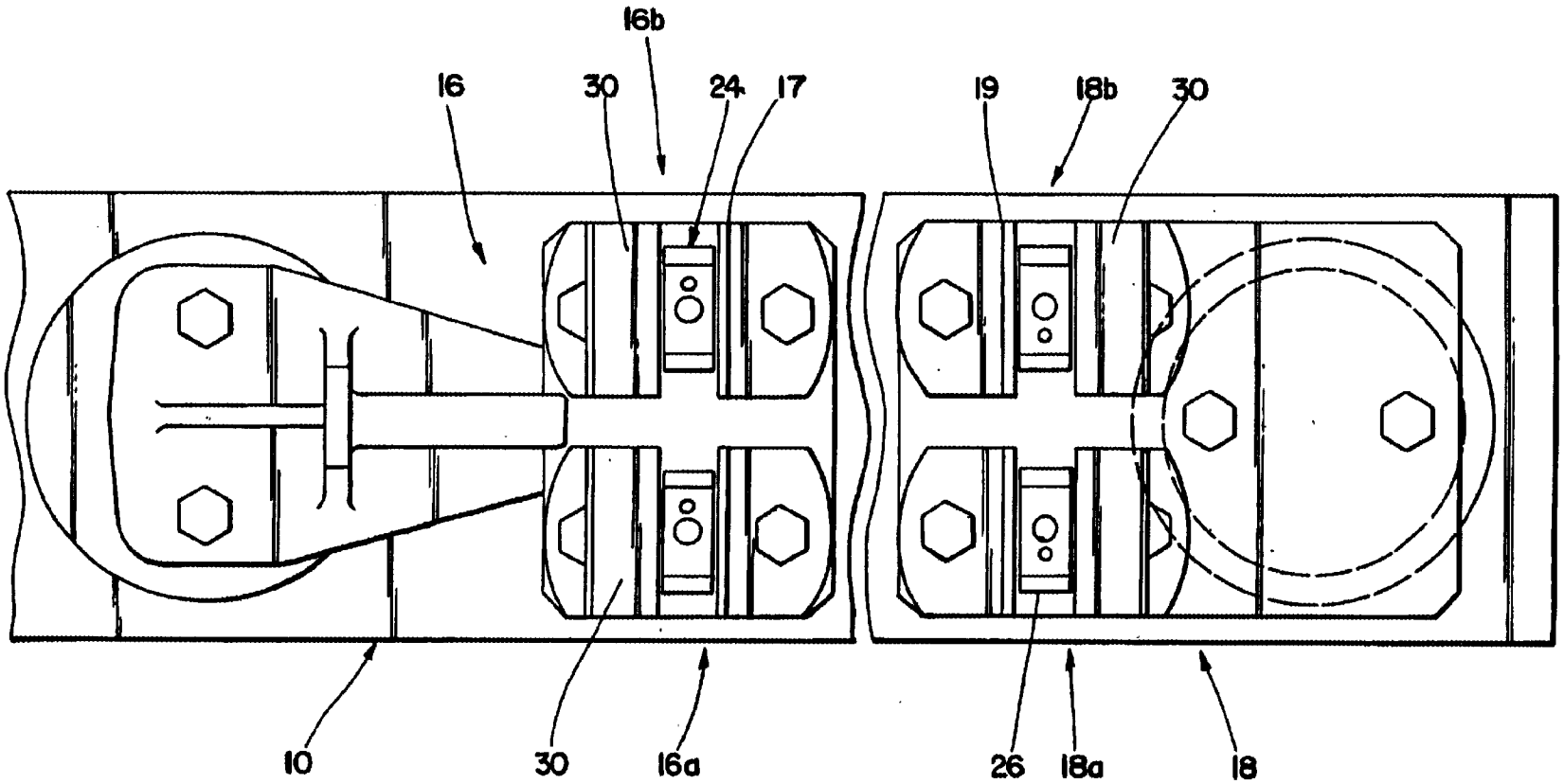
FIG. 2 is a top plan view of the mounting of FIG. 1.

Referring now to FIGS. 1 and 2, the mounting 10 of the present invention is illustrated supporting a circuit interrupter 12, e.g. for use in metal-enclosed gear or the like in the electrical power transmission and distribution field. In the specific illustrative embodiment, the mounting 10 also supports a second circuit-interrupter 14 so as to function as a double interrupter mounting. The circuit interrupters 12, 14 are fuses or the like, for example, of the general type shown in U.S. Pat. No. 4,123,639 and available under the tradename NX fuses from Cooper Industries. Of course, it should be understood that the mounting 10 of the present invention is suitable for use with other types of circuit-interrupting devices.

The mounting 10 includes upper and lower terminal and support arrangements 16, 18 respectively that cooperate with upper and lower device mounting studs 20, 22 respectively of the circuit interrupters 12, 14. The device mounting studs 20, 22 also function as electrical circuit connection points to connect the circuit interrupters 12, 14 in an electrical circuit via respective upper and lower contact assemblies 24, 26 of the mounting 10. In the illustrative embodiment the upper and lower contact assemblies include resilient retention facilities for providing suitable electrical contact forces when engaged with the device mounting studs 20, 22. Thus, the upper and lower terminal and support arrangements 16, 18 retain the circuit interrupters 12, 14 within the mounting 10 and in suitable electrical circuit connection. The upper and lower terminal and support arrangements 16, 18 also preferably include respective guiding arrangements 17, 19 that are bifurcated to receive and guide the device mounting studs 20, 22 during insertion of the circuit interrupters 12, 14.

In the illustrative embodiment, each of the upper and lower terminal and support arrangements are selectively operable to release the circuit interrupters 12, 14 for removal from the mounting 10, e.g. upper and lower terminal and support arrangements 16*a*, 18*a* are operable to release the circuit interrupter 12 and upper and lower terminal and support arrangements 16*b*, 18*b* are operable to release the circuit interrupter 14. Accordingly, the circuit interrupters 12, 14 are each individually removable from the mounting 10. In another specific embodiment, the upper terminal and support arrangement 16 is operable to release the circuit interrupters 12, 14 with the lower terminal and support arrangement 18 being of the general type as shown in U.S. Pat. No. 4,123,639.

In a specific application, the circuit interrupters 12, 14 are current-limiting fuses that are rather massive (e.g. 30 pounds or more) and are intended for deenergized circuit manipulation by an operator for removal and replacement. For example, the upper and lower terminal and support arrangements 16, 18 are operable via a hookstick to release the circuit interrupter 12 or 14 and a stick with a clamp attachment is utilized to grasp and remove the circuit interrupter 12 or 14 from the mounting 10. Reference may be made to S&C Electric Company Descriptive Bulletin 851-30 for more information on such handling tools.

Figure 3:
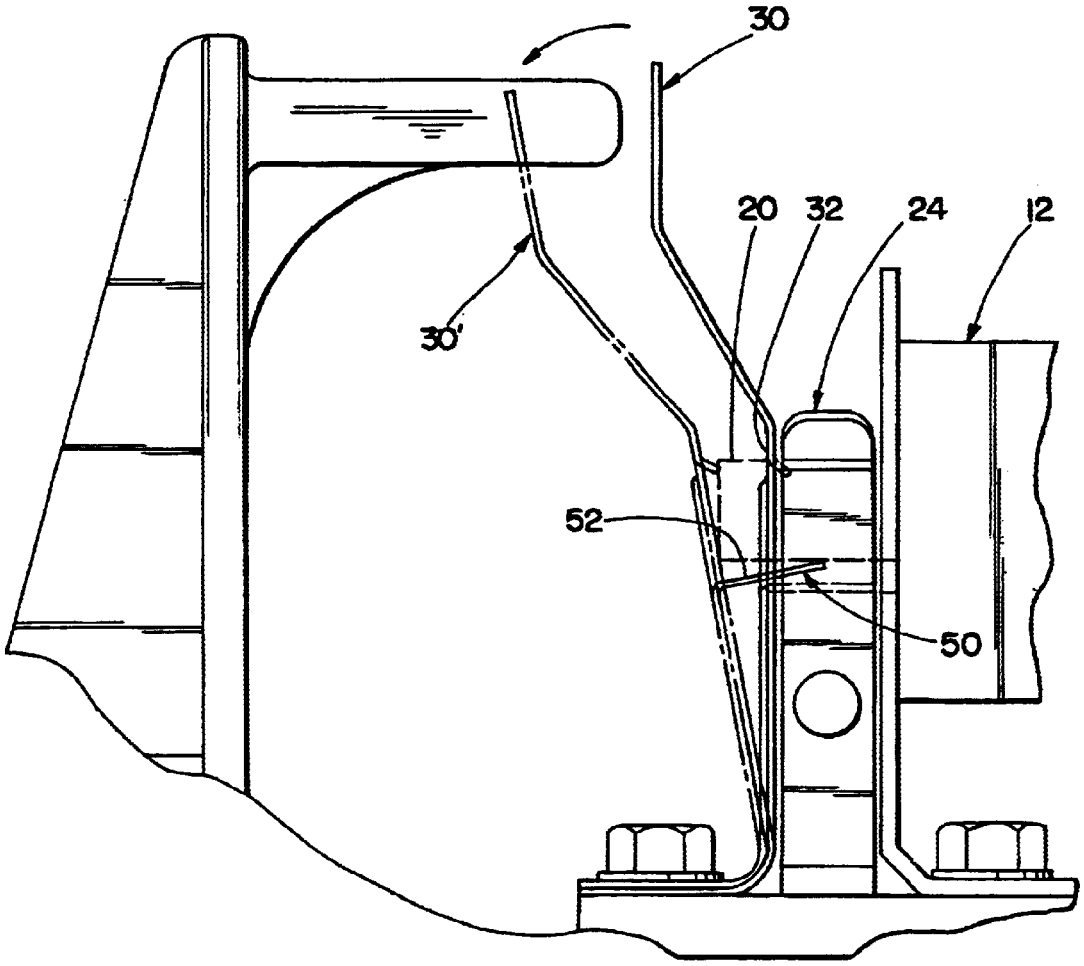
FIG. 3 is an enlarged view of an upper portion of the mounting of FIGS. 1 and 2 illustrating operation thereof.
Figure 4:
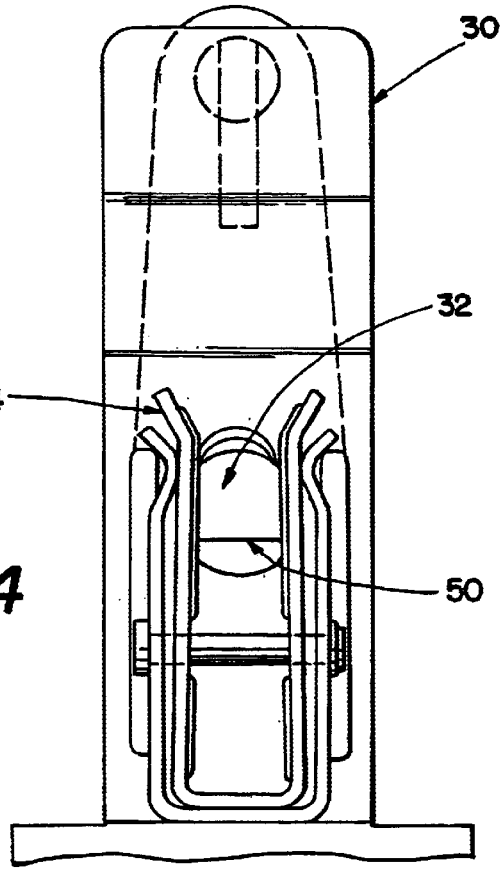
FIG. 4 is a side elevational view of FIG. 3.

In accordance with the illustrative embodiment and with additional reference now to FIGS. 3–4, each of the upper and lower terminal and support arrangements 16*a*, 16*b*, 18*a* and 18*b* include a latch arm 30 that is moved to release the respective device mounting stud 20, 22 from a retained holding position to a latch released position. In a specific embodiment, the latch arms 30 include holes 32 formed therethrough for passage of the device mounting studs 20, 22 and engagement and retention thereof by the latch arms 30. Thus, the latch arms 30 retain the circuit interrupters 12, 14 in the mounting 10 until operated by manipulation away from the device mounting studs 20, 22 so as to release the device mounting studs 20, 22 from engagement within the holes 32.

Figure 5:
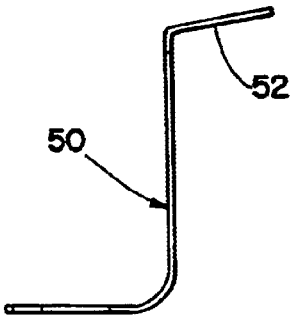
FIGS. 5–7 are respective front, right-side and top elevational views of a resilient guiding member of the mounting of FIGS. 1–3 .
Figure 6:
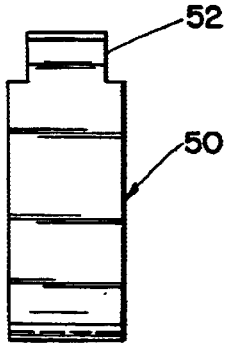
Figure 7:
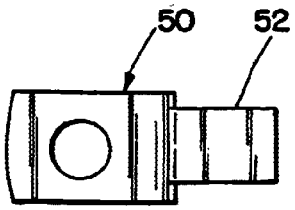

In accordance with important aspects of the present invention, the mounting 10 includes facilities to simplify the removal of the circuit interrupters 12, 14 from the mounting 10. Specifically, and with additional reference now to FIGS. 5–7, the mounting 10 includes a resilient guiding member 50 that cooperates with the latch arm 30 to retain the circuit interrupter 12 or 14 in a latched released position after operation of the latch arm 30. The resilient guiding member 50 includes a protruding arm 52 that acts against the device mounting studs 20, 22 as the respective latch arms 30 are moved outwardly to release the device mounting studs 20, 22. Accordingly, the resilient guiding member 50 both pushes against the device mounting studs 20, 22 to move the circuit interrupters 12 or 14 out of the latched position and acts against the circuit interrupters 12 or 14 for retention in the latch released position. That is, without the resilient guiding member 50, the circuit interrupters 12, 14 tend to move back toward the latched position unless the latch arm 30 is held toward the open, released position. Thus, with the present invention, one operator can perform the removal of the circuit interrupter 12 or 14 whereas otherwise, two operators would be required, i.e. one operator to hold the latch arm 30 open while the second operator clamps onto and removes the circuit interrupter 12, 14 from the mounting 10.

While there has been illustrated and described a preferred embodiment of the present invention, it will be apparent that various changes and modifications will occur to those skilled in the art. Accordingly, it is intended in the appended claims to cover all such changes and modifications that fall within the true spirit and scope of the present invention.

What is claimed is:

1. A mounting for a circuit interrupter having spaced apart first and second contacts, the mounting comprising:

a pair of fixedly mounted contacts having resilient characteristics providing contact force when the first and second contacts of the circuit interrupter are engaged with the mounting;

at least one latch at one of said fixedly mounted contacts that is engageable for movement from a holding position to a latch release position to release a latch holding force on one of the contacts of the circuit interrupter; and first means for assisting retention of the circuit interrupter in the latch released position for removal of the circuit interrupter.

2. The mounting of claim 1 wherein said latch comprises a resilient latch arm.

3. The mounting of claim 2 wherein said first means comprises a resilient member carried by said latch arm.

4. The mounting of claim 3 wherein the circuit interrupter includes at least one protruding mounting stud, said resilient member including a protruding arm that is arranged to engage the device mounting stud of the circuit interrupter when the latch arm is moved to the latch release position.

5. The mounting of claim 4 comprising one of said latches located at each of said fixedly mounted contacts and one of said first means being provided for each of said latches.

* * * * *